US010499734B2

(12) United States Patent
Young

(10) Patent No.: US 10,499,734 B2
(45) Date of Patent: Dec. 10, 2019

(54) MODULAR HANGING STORAGE SYSTEM

(71) Applicant: Nelson B. Young, Holbrook, NY (US)

(72) Inventor: Nelson B. Young, Holbrook, NY (US)

( * ) Notice: Subject to any disclaimer, the term of this patent is extended or adjusted under 35 U.S.C. 154(b) by 0 days.

(21) Appl. No.: 15/974,256

(22) Filed: May 8, 2018

(65) Prior Publication Data

US 2018/0249831 A1 Sep. 6, 2018

Related U.S. Application Data

(63) Continuation of application No. 14/966,847, filed on Dec. 11, 2015, now Pat. No. 9,962,020.

(51) Int. Cl.

| | |
|---|---|
| ***A47B 88/04*** | (2006.01) |
| ***A47F 5/00*** | (2006.01) |
| ***E05D 15/06*** | (2006.01) |
| ***A47B 81/00*** | (2006.01) |
| ***A47B 88/42*** | (2017.01) |
| ***A47B 53/00*** | (2006.01) |
| *A47G 1/06* | (2006.01) |
| *A47G 1/12* | (2006.01) |
| *A47G 1/14* | (2006.01) |

(52) U.S. Cl.

CPC ..... *A47B 81/00* (2013.01); *A47B 53/00* (2013.01); *A47B 88/42* (2017.01); *A47B 2088/421* (2017.01); *A47G 1/0616* (2013.01); *A47G 1/12* (2013.01); *A47G 1/14* (2013.01)

(58) Field of Classification Search

CPC ..... A47F 7/0042; A47B 53/02; A47B 53/00; A47B 88/42

See application file for complete search history.

(56) References Cited

U.S. PATENT DOCUMENTS

| | | | | | |
|---|---|---|---|---|---|
| 1,005,055 | A | | 10/1911 | Miller | |
| 2,923,584 | A | | 2/1960 | Broderick, Jr. | |
| 3,135,570 | A | | 6/1964 | Erismann | |
| 3,833,280 | A | * | 9/1974 | Bell | A47B 63/06 312/107 |
| 3,909,093 | A | * | 9/1975 | Lundberg | A47B 63/06 312/294 |
| 3,912,086 | A | | 10/1975 | de Bruyn | |
| 4,030,609 | A | | 6/1977 | Liebetrau | |
| 4,036,370 | A | | 7/1977 | Chevalier | |
| 4,084,125 | A | | 4/1978 | King | |
| 4,139,248 | A | * | 2/1979 | Hornbacher | B42F 15/063 211/125 |
| 4,144,972 | A | * | 3/1979 | Wiser | A47B 88/00 211/113 |
| 4,301,623 | A | * | 11/1981 | Demukai | E05F 1/16 16/78 |

(Continued)

*Primary Examiner* — Kimberley S Wright

(74) *Attorney, Agent, or Firm* — The Farrell Law Frim, P.C.

(57) ABSTRACT

A hanging storage unit is provided. The hanging storage unit includes a lower frame structure including at least one roller assembly, an upper frame structure including at least one guide assembly, a plurality of posts coupled at a lower end to the lower frame structure and coupled at an upper end the upper frame structure, a guidance tube, moveably engaged with one of the at least one guide assembly, and a panel, an upper end of the panel attached to the guidance tube and a lower end of the panel moveably engaged with one of the at least one roller assembly.

16 Claims, 9 Drawing Sheets

(56) References Cited

U.S. PATENT DOCUMENTS

| | | | | |
|---|---|---|---|---|
| 4,657,317 | A | 4/1987 | Gemma | |
| 4,818,043 | A * | 4/1989 | Borgen | A47F 3/043 297/116 |
| 5,031,782 | A | 7/1991 | Minervini | |
| 5,680,938 | A | 10/1997 | Rubinstein | |
| 5,924,577 | A | 7/1999 | Gessert | |
| 5,924,779 | A | 7/1999 | Krumholz | |
| 5,943,967 | A * | 8/1999 | Sherman | A47B 53/00 108/102 |
| 5,967,346 | A | 10/1999 | Price, Jr. | |
| 6,036,286 | A | 3/2000 | Krumholz | |
| 6,484,893 | B1 | 11/2002 | Tkatch | |
| 6,564,951 | B2 | 5/2003 | Hatami | |
| 7,770,259 | B2 * | 8/2010 | Janson | E05D 15/0652 104/89 |
| 9,962,020 | B2 * | 5/2018 | Young | A47B 81/00 |
| 2002/0005687 | A1 | 1/2002 | Corona | |
| 2002/0011456 | A1 | 1/2002 | Hatami | |
| 2008/0190876 | A1 | 8/2008 | Janson | |
| 2011/0133044 | A1 | 6/2011 | Pepe | |
| 2012/0067834 | A1 | 3/2012 | Gokey | |

* cited by examiner

MODULAR HANGING STORAGE SYSTEM

PRIORITY

This application is a continuation application of and claims priority to U.S. patent application Ser. No. 14/966,847, which was filed on Dec. 11, 2015, the entire contents of which is incorporated herein by reference.

BACKGROUND

1. Field of the Invention

The present invention relates generally to a hanging storage system, and more particularly, to a modular storage system for hanging items such as artwork, including pictures, paintings, etc.

2. Description of the Related Art

Museums and private art collectors frequently use hanging storage units to store artwork. These units are often quite large in size and consist of a large number of components. To ensure structural integrity, these units are generally fixed to walls and/or ceilings due to their size, thus causing potential damage to spaces where the units are in use. Conventional units generally run on a track system, thus in spaces where surfaces are uneven, use of such units may be problematic. These conventional units often require multiple skilled installers to assemble. This can be costly and intimidating. Additionally, it makes relocation and disassembly of the units a challenge for the owners. Accordingly, what is needed is a stable, free-standing, trackless hanging storage system that is easy to assemble and disassemble—a system which is modular and customizable in size to accommodate various spaces.

SUMMARY

The present invention has been designed to address at least the above-described problems and disadvantages, and to provide at least the advantages described below.

Accordingly, an aspect of the present invention is to provide an easy-to-assemble storage system for hanging items.

Accordingly, another aspect of the present invention is to provide a storage system which is modular and optimally utilizes space to maximize storage capabilities.

Accordingly, yet another aspect of the present invention is to provide a storage system which additionally serves the purpose of easily displaying the stored items.

Accordingly, yet another aspect of the present invention is to provide a storage system which results in minimal disturbance to the installation space.

In accordance with an aspect of the present invention, a hanging storage unit is provided. The hanging storage unit includes a lower frame structure including at least one roller assembly, an upper frame structure including at least one guide assembly, a plurality of posts coupled at a lower end to the lower frame structure and coupled at an upper end the upper frame structure, a guidance tube, moveably engaged with one of the at least one guide assembly, and a panel, an upper end of the panel attached to the guidance tube and a lower end of the panel moveably engaged with one of the at least one roller assembly.

In accordance with an aspect of the present invention, a hanging storage unit is provided. The hanging storage unit includes a frame, at least one guidance tube, and at least one panel. The frame includes a plurality of base extrusions, at least one lower guidance structure, at least one upper frame structure, and a plurality of posts. Each lower guidance structure includes a plurality of roller assemblies, wherein the at least one lower guidance structure is coupled to a first base extrusion and a second base extrusion of the plurality of base extrusions. The at least one upper frame structure has a rectangular shape and includes an upper guidance structure disposed on an inner perimeter of the at least one upper frame structure. The upper guidance structure includes a first set of guide assemblies, and a second set of guide assemblies. Each post of the plurality of posts is coupled at a lower end to each end of the plurality of base extrusions and coupled at an upper end to each corner of the at least one upper frame structure. The at least one guidance tube is inserted through one of the guide assemblies of the first set of guide assemblies and a corresponding one of the guide assemblies of the second set of guide assemblies, and an upper end of the at least one panel is attached to the at least one guidance tube, and a lower end of the at least one panel is engaged with one of the plurality of roller assemblies.

BRIEF DESCRIPTION OF THE DRAWINGS

The above and other aspects, features, and advantages of certain embodiments of the present invention will be more apparent from the following description taken in conjunction with the accompanying drawings, in which.

DETAILED DESCRIPTION OF EMBODIMENTS OF THE PRESENT INVENTION

Figure 1A:
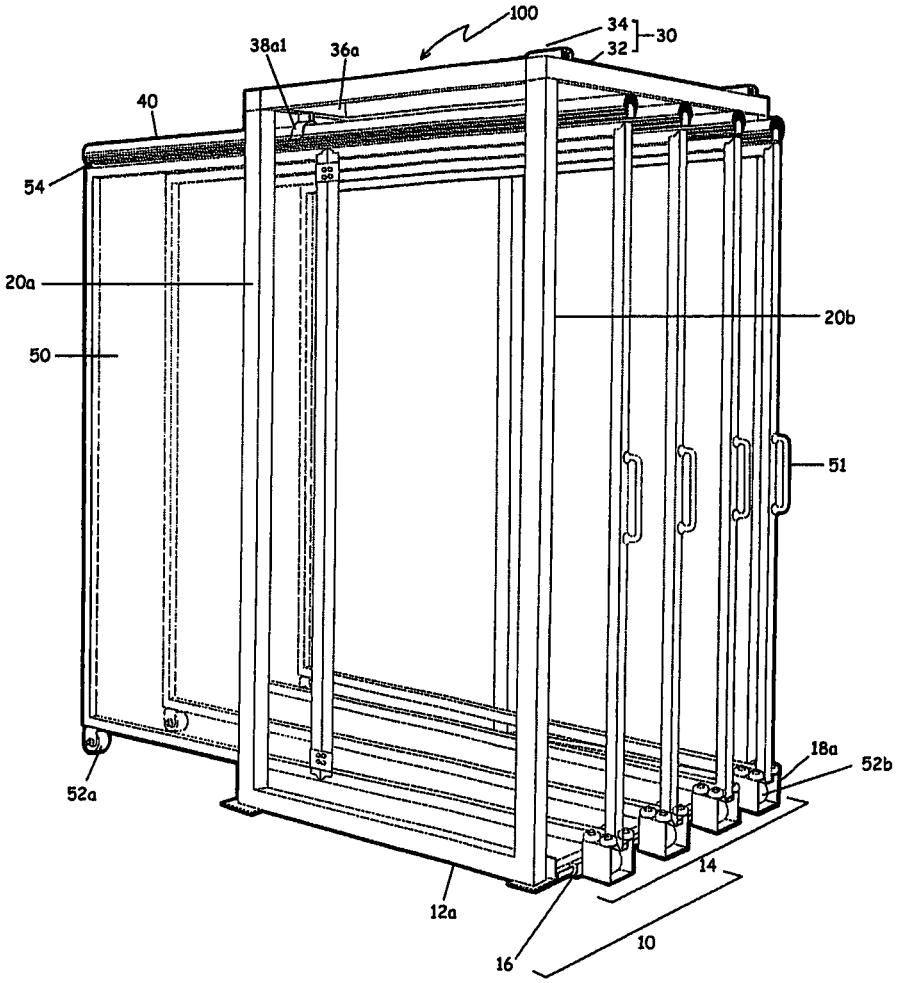
FIGS. 1A and 1B illustrate a hanging storage system, according to an embodiment of the present invention.

Various embodiments of the present invention will now be described in detail with reference to the accompanying drawings. In describing the drawings, similar reference numerals will be used to describe like elements and components. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Figure 1B:
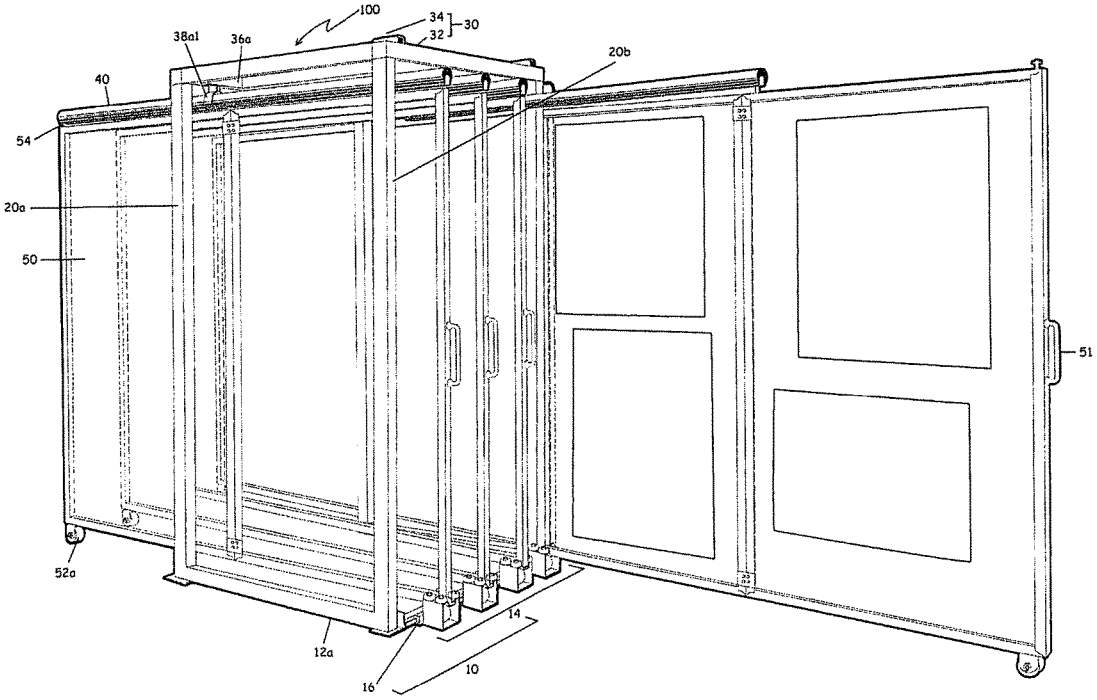

FIGS. 1A and 1B illustrate a hanging storage system, according to an embodiment of the present invention.

Referring to FIGS. 1A and 1B, a modular hanging storage system 100 is provided. The hanging storage system 100 includes a lower frame structure 10, a plurality of posts 20, an upper frame structure 30, at lease one guidance tube 40, and at least one panel 50.

The lower frame structure 10 consists of at least two base extrusions 12, such as a first base extrusion 12*a* and a second base extrusion 12*b* (see FIG. 8A), and at least one lower guidance structure 14.

The first base extrusion 12*a* and the second base extrusions 12*b* are disposed parallel to one another and are to be bolted to the floor to provide the foundation for the modular hanging system 100. Each of the first base extrusion 12*a* and the second base extrusions 12*b* have a bracket projected in a perpendicular direction from an upper surface of each end of the base extrusion. A first end of the first base extrusion 12*a* is perpendicularly coupled to a first end of the lower guidance structure 14, and a first end of the second base extraction 12*b* is perpendicularly coupled to a second end of the lower guidance structure 14. Being coupled in this manner, the first base extrusion 12*a*, the lower guidance structure 14, and the second base extrusion 12*b* form the lower frame structure 10 a rectangular shape with one end open.

The lower guidance structure 14 includes a lower guidance rail 16 having disposed thereon at least one roller assembly 18 (see FIGS. 3A to 3C), such as a first roller assembly 18*a*.

Each of the plurality of posts 20 are coupled at a lower end to one of the brackets of the base extrusion 12*a* and a second base extrusion 12*b* such that the plurality of posts 20 extend in a vertical direction. In this configuration there are four posts 20—a first post 20*a* coupled to a first end of the first base extrusion 12*a*, a second post 20*b* coupled to a second end of the first base extrusion 12*a*, a third post 20*c* (see FIG. 8A) coupled to a first end of the second base extrusion 12*b*, and a fourth post coupled to a second end of the second base extrusion 12*b*.

The upper frame structure 30 consists of an upper frame 32 and an upper guidance structure 34.

The upper frame 32 is formed in rectangular shape, similar to the shape and size of the lower frame structure 10. The upper frame 32 has a bracket projected in a perpendicular direction from a bottom surface of each corner of the upper frame structure 30.

The upper guidance structure 34 consists of a first upper guidance rail 36*a* having disposed thereon at least one guide assembly 38 (see FIGS. 5A to 5C), such as a first guide assembly 38*a*1; a second upper guidance rail 36*b* (see FIG. 4) having disposed thereon at least one guide assembly 38, such as a first guide assembly 38*a*2; and at least one bar disposed perpendicularly between the first upper guidance rail 36*a* and the second upper guidance rail 36*b*, such that the first upper guidance rail 36*a* and the second upper guidance rail 36*b* are formed parallel to one another.

The number of guide assemblies 38 on the first upper guidance rail 36*a* is the same as the number of guide assemblies 38 on the second upper guidance rail 36*b*. Each of the guide assemblies 38 on the first upper guidance rail 36*a* are positioned opposite and parallel to corresponding guide assemblies 38 on the second upper guidance rail 36*b*. For example, the first guide assembly 38*a*1 on the first upper guidance rail 36*a* is positioned opposite and parallel to the first guide assembly 38*a*2 on the second upper guidance rail 36*b*.

Additionally, the number of guide assemblies 38 on the first upper guidance rail 36*a* and the number of guide assemblies 38 on the second upper guidance rail 36*b* is the same as the number of roller assemblies 18 on the lower guidance rail 16. For example, if there are two guide assemblies 38 on both the first upper guidance rail 36*a* and the second upper guidance rail 36*b*, then there are also two roller assemblies 18 on the lower guidance rail 16.

The upper guidance structure 34 is coupled to a top surface of the upper frame 32 to form the upper frame structure 30. The individual couplings of the guidance structure 34 to the upper frame 32 is adjustable so the first upper guidance rail 36*a* and the second upper guidance rail 36*b* of the upper guidance structure 34 separately varied in height to accommodate uneven floors and, thus, prevent the guidance tube 40 from disengaging from the guide assemblies 38. Accordingly, the couplings may be adjusted to position the first upper guidance rail 36*a* and the second upper guidance rail 36*b* of the upper guidance structure 34 level and parallel with the surface on which the hanging storage system 100 is installed.

The upper frame structure 30 is formed in a size and shape that is substantially similar to the size and the shape of the lower frame structure 10. The upper frame structure 30 is disposed above the plurality of posts 20 such that each bracket of the upper frame 32 is coupled to an upper end of one of the plurality of posts 20. When thus coupled, each of the guide assemblies 38 on the second upper guidance rail 36*b* is positioned on the same vertical plane as corresponding roller assemblies 18 on the lower guidance rail 16. For example, the first guide assembly 38*a*2 is positioned on the same vertical plane as the first roller assembly 18*a*.

The guidance tube 40 is to be inserted through one of the guide assemblies 38 on the first guidance rail 36*a* and a corresponding one of the guide assemblies 38 on the second rail 36*b*. The guidance tube 40 is capable of sliding back and forth through one of the guide assemblies 38 through which it is inserted.

The panel 50 has at least one wheel 52 disposed at each end of the panel 50 on a bottom surface, such as a first wheel 52*a* and a second wheel 52*b*, although any component that permits sliding of the panel 50 is contemplated. The panel 50 additionally has a plurality of pins 54 disposed at various intervals on a top surface of the panel 50. The panel 50 is attached at an upper end, by the plurality of pins 54, to a bottom surface of the guidance tube 40. The panel 50 is engaged at a lower end with the one of the roller assemblies 18 on the lower guidance rail 16. Coupled in this manner, the panel is capable of sliding back and forth through the roller assemblies 18 while also sliding back and forth through the guidance tube 40. As noted above, the guidance tube 40 is also capable of sliding back and forth through one of the guide assemblies 38 through which it is inserted. Thus, as the panel 50 slides, the guidance tube 40 slides along with the panel 50. In this way, the panel 50 may be slid to a position where at least a portion of the guidance tube 40 and a portion of the panel 50 extend beyond the frame of the hanging storage system 100. While thus extended, the panel 50 may be further slid to telescope to a position where the panel 50 extends beyond the guidance tube 40, such that the full width of the panel 50 is exposed beyond the frame of the hanging storage system 100, as shown in FIG. 1B. As the panel 50 slides it is kept straight by the roller assemblies 18 below and the guidance tube 40 engaged in the guide assemblies 38 above.

The hanging storage system 100 is designed for ease of assembly and disassembly. Accordingly, the various structural components of the hanging storage system 100, such as the lower frame structure 10, the plurality of posts 20, the upper frame structure 30, the at lease one guidance tube 40, and the at least one panel 50, are composed of aluminum or a similar material to provide for a lightweight structure. Each of the structural components weighs less than 30 lbs (14 kg). Additionally, the various structural components of the hanging storage system 100 are coupled to each other through bolted connections for ease of assembly and disassembly.

The hanging storage system 100 is modular and customizable. The hanging storage system 100 may be construed in various sizes allowing for the use of various numbers of panels 50. The roller assemblies 18 and the guide assemblies 38 are easily removable, such that any number of roller assemblies 18 and guide assemblies 38 as will fit on the corresponding rails may be used in the hanging storage system 100. Additionally, the roller assemblies 18 and the guide assemblies 38 are adjustable, such that a user of the hanging storage system 100 may move each along its corresponding rail to an appropriate position at which the user may secure the assembly. In this way, each panel 50 may be spaced apart at regular or irregular intervals.

Figure 2:
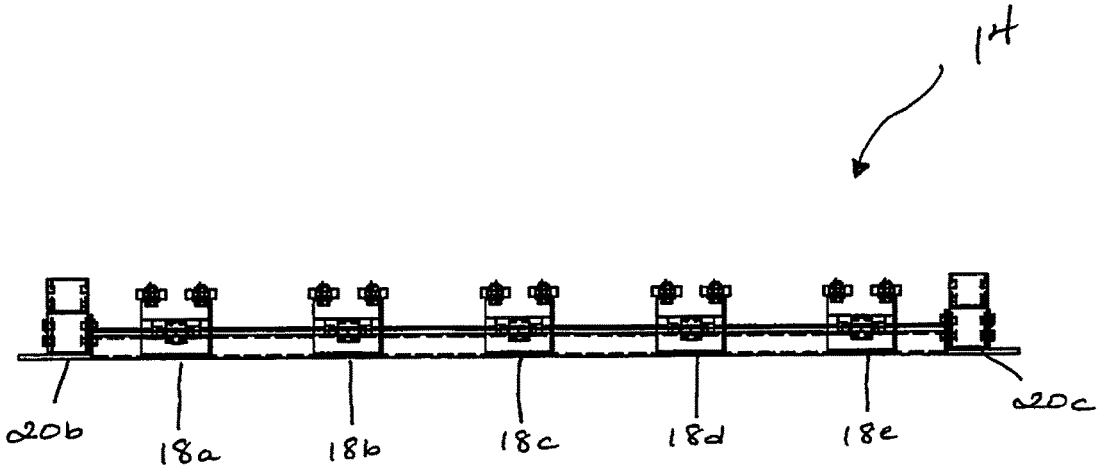
FIG. 2 illustrates a lower guidance structure of the hanging storage system, according to an embodiment of the present invention.

FIG. 2 illustrates a lower guidance structure of the hanging storage system, according to an embodiment of the present invention.

Referring to FIG. 2, the lower guidance structure 14 of the hanging storage system 100 is provided. The lower guidance structure 14 includes at least one roller assembly 18, such as the first roller assembly 18*a*, a second roller assembly 18*b*, a third roller assembly 18*c*, a fourth roller assembly 18*d*, and a fifth roller assembly 18*e*, disposed on the lower guidance rail 16. The at least one roller assembly 18 is removably connected to the lower guidance rail 16. The at least one roller assembly 18 is connected on an outer surface of the lower guidance rail 16, where the outer surface is the surface which faces the outside of the hanging storage system 100. The lower guidance rail 16 has a ridge 17 (as shown in FIG. 3C) on the upper surface which the at least one roller assembly 18 may move horizontally along so that the at least one roller assembly 18 may be positioned in a location desirable to the user. The lower guidance rail 16 may have printed on an upper surface, a ruler (as shown in FIG. 3B) for allowing a user to precisely position the at least one roller assembly 18. The at least one roller assembly 18 is fixed in place along the ridge 17 with a bolted connection which may be fastened by hand by a user (e.g., by using a tool such as wrench or an Allen key, for example). Thus, the at least one roller assembly 18 may be easily adjusted or removed by the user.

Figure 3A:
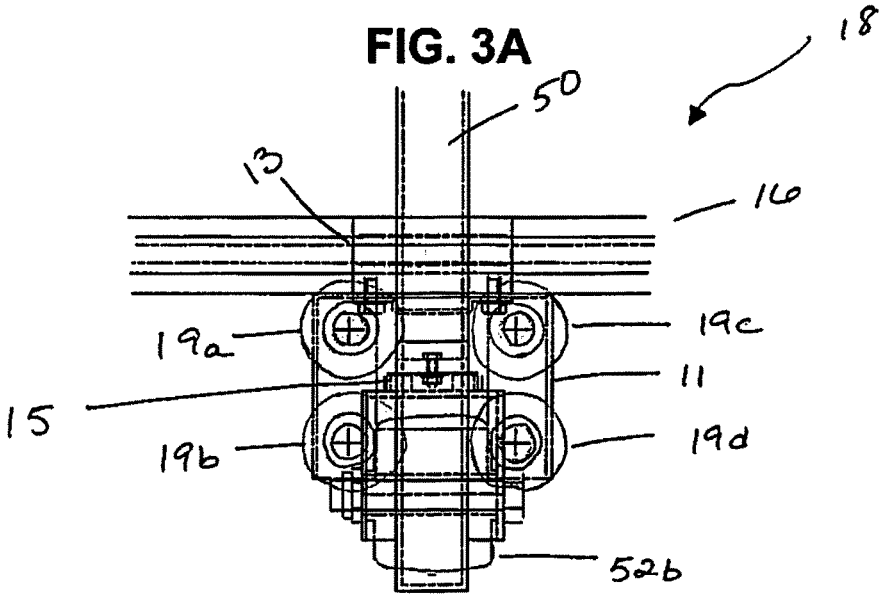
FIGS. 3A to 3C illustrate views of a roller assembly of the hanging storage system, according to an embodiment of the present invention.
Figure 3B:
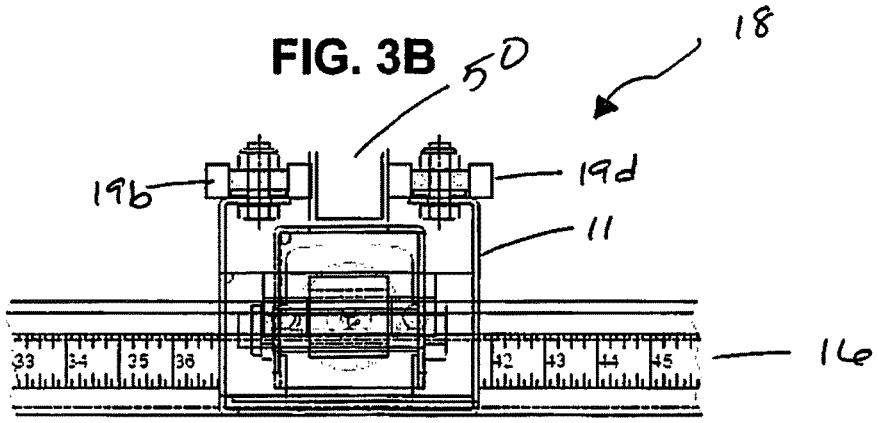
Figure 3C:
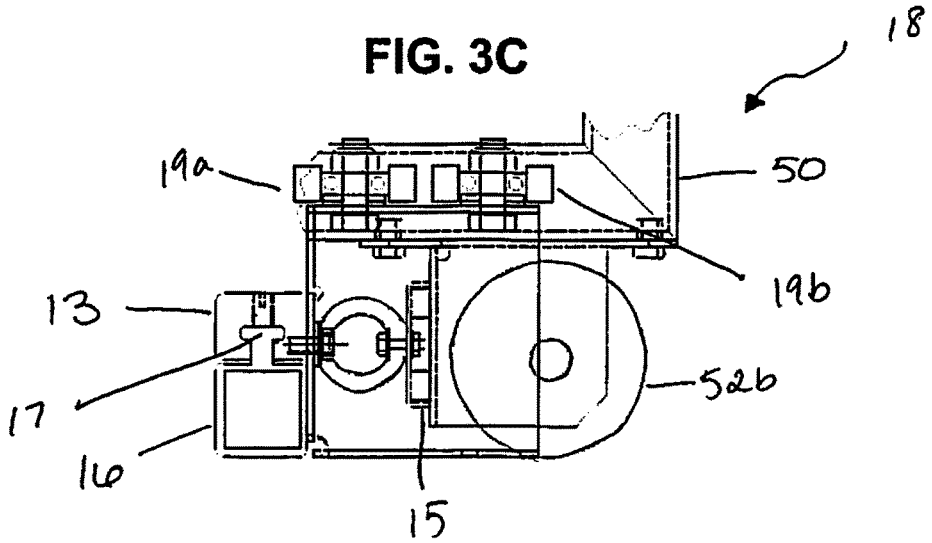

FIGS. 3A to 3C illustrate views of a roller assembly of the hanging storage system, according to an embodiment of the present invention.

Referring to FIGS. 3A, 3B, and 3C, respectively, a top view, front view, and a cross-sectional view of the roller assembly 18 of the hanging storage system 100 is provided. The roller assembly 18 includes of a bracket 11 having a bottom and two open sides. The bracket 11 is attached to a bar 13. The bar 13 has a groove for attaching to the ridge 17 of the lower guidance rail 16, so that the roller assembly 18 may move along the ridge 17 as described with reference to FIG. 2. The bracket 11 has disposed thereon a first roller 19*a*, a second roller 19*b*, a third roller 19*c*, and a fourth roller 19*d*. The first roller 19*a* and the second roller 19*b* are disposed on one side of the bracket and the third roller 19*c* and the fourth roller 19*d* are disposed on the opposite side of the bracket. The first roller 19*a* and the second roller 19*b* are separated from the third roller 19*c* and the fourth roller 19*d* by a space of a predetermined width. The space accommodates the panel 50 as it slides between the rollers, as described with reference to FIGS. 1A and 1B. The predetermined width of the space corresponds to the thickness of the panel 50.

A magnetic catch 15 is disposed in the space, as shown in FIG. 3C. The magnetic catch 15 is provided to catch the panel 50 and prevent the panel 50 from moving when the panel is in the closed position, as shown in FIG. 1A. At least a portion of the second wheel 52*b* of the panel 50 consists of a ferromagnetic material, such as iron, nickel, steel, etc., to cause the wheel 52*b* to attach to the magnetic catch 15 when the second wheel 52*b* is pushed into the roller assembly 18. The user may hear a click when the second wheel 52*b* is engaged with the magnetic catch 15 to know that the panel is closed. This is particularly useful when the hanging storage system 100 is installed on an uneven or sloping surface. The magnetic catch 15 also serves as a stop to prevent the second wheel 52*b*, and thus the panel 50, from disengaging from the roller assembly 18 as the panel 50 is pushed into the hanging storage system 100. Additionally, when the panel 50 is pulled to extend out of the hanging storage system 100 in the opened position, as shown in FIG. 1B, the magnetic catch 15 serves as a stop to prevent the first wheel 52*a*, and thus the panel 50, from disengaging from the roller assembly 18.

Figure 4:
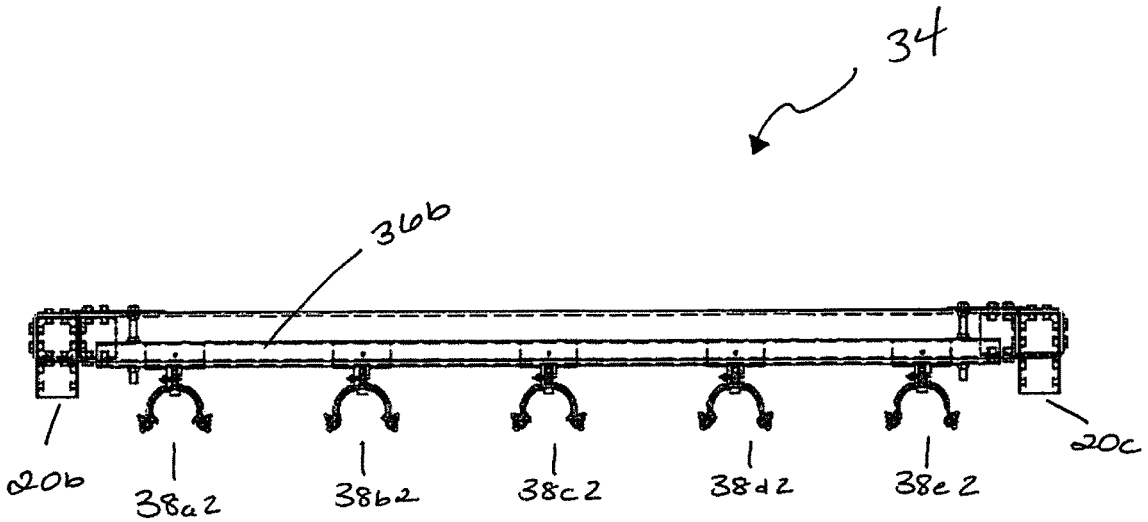
FIG. 4 illustrates an upper guidance structure of the hanging storage system, according to an embodiment of the present invention.

FIG. 4. illustrates an upper guidance structure of the hanging storage system, according to an embodiment of the present invention.

Referring to FIG. 4, the upper guidance structure 34 of the hanging storage system 100 is provided, showing the second upper guidance rail 36*b* having disposed thereon at least one guide assembly 38, such as the first guide assembly 38*a*2, a second guide assembly 38*b*2, a third guide assembly 38*c*2, a fourth guide assembly 38*d*2, and a fifth guide assembly 38*e*2. Like the roller assembly 18, the guide assembly 38 is removably connected to the second upper guidance rail 36*b*. Each guide assembly 38 is connected on an outer surface of the second upper guidance rail 36*b*, where the outer surface is the surface which faces the outside of the hanging storage system 100. The second upper guidance rail 36*b* has a ridge 37 (shown in FIG. 5C) on the outer surface on which the at least one guide assembly 38 may move horizontally along so that the at least one guide assembly 38 may be positioned in a location desirable to the user. The second upper guidance rail 36*b* may have printed on the upper surface, a ruler (shown in FIG. 5B) for allowing a user to precisely position the at least one guide assembly 38. The user may use the ruler to precisely position the at least one guide assembly 38 to align with a corresponding the roller assembly 18 positioned below. The at least one guide assembly 38 is fixed in place along the ridge 37 with a bolted connection which may be fastened by hand by a user (e.g., by using a tool such as wrench or an Allen key, for example). Thus, the at least one guide assembly 38 may be easily adjusted or removed by the user.

The first upper guidance rail 36*a* is configured in the same manner as the second upper guidance rail 36*b*, and thus a detailed description will be omitted.

Figure 5A:
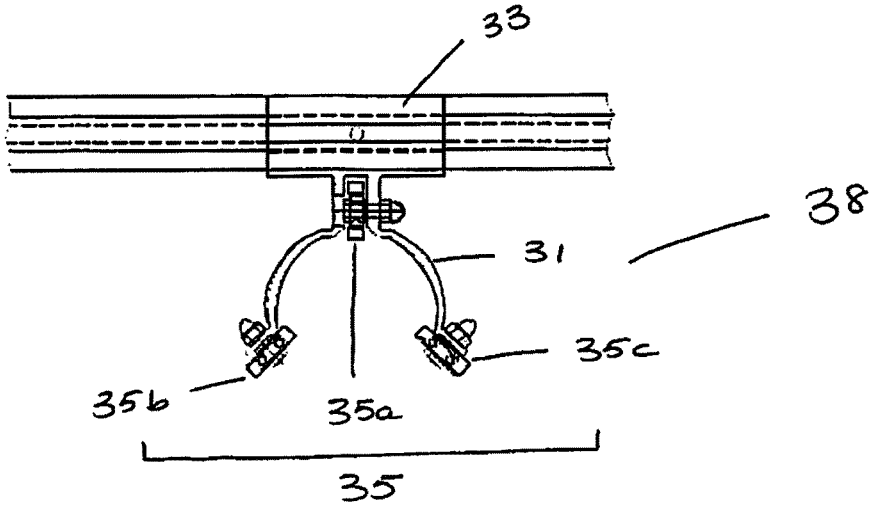
FIGS. 5A to 5C illustrate views of a guide assembly of the hanging storage system, according to an embodiment of the present invention.
Figure 5B:
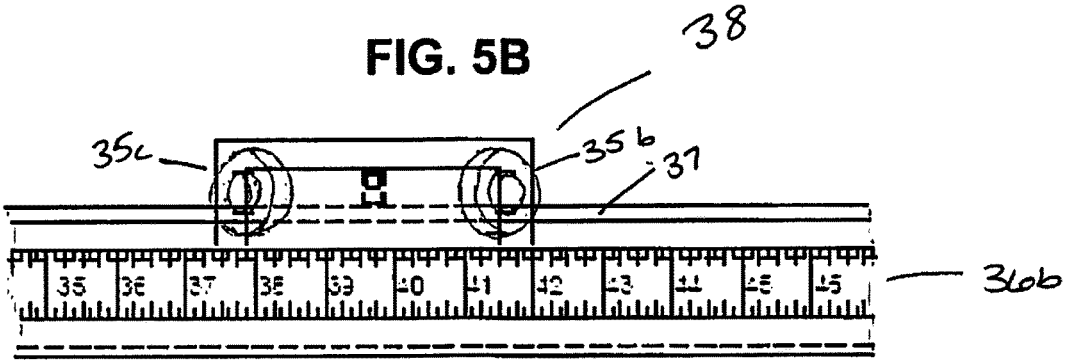
Figure 5C:
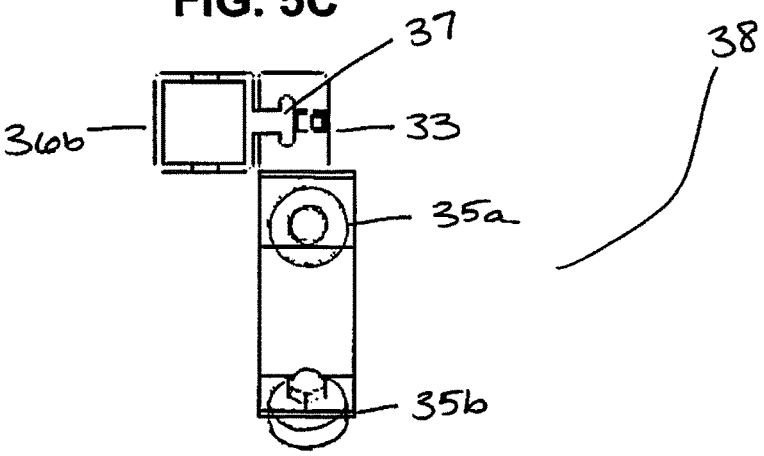

FIGS. 5A to 5C illustrate views of a guide assembly of the hanging storage system, according to an embodiment of the present invention.

Referring to FIGS. 5A, 5B, and 5C, respectively, a front view, top view, and a side view of the guide assembly 38 is provided. The guide assembly 38 has a semi-circle shape guidance tube enclosure 31 having flanged edges. The shape of the guidance tube enclosure 31 corresponds to the shape of the guidance tube 40. The guidance tube enclosure 31 is attached to a bar 33. The bar 33 attaches to the ridge 37 of the second upper guidance rail 36*b*, so that the guide assembly 38 may move along the ridge 37, as described with reference to FIG. 4. The guidance tube enclosure 31 has a plurality of rollers 35 for smoothly guiding the guidance tube 40 through the guidance tube enclosure 31. A first roller 35*a* is disposed at a top center position of the guidance tube enclosure 31, and a second roller 35*b* and a third roller 35*c* are disposed on each flanged edged of the guidance tube enclosure 31.

FIGS. 6A to 6D illustrate views of a guidance tube of the hanging storage system, according to an embodiment of the present invention.

Figure 6A:
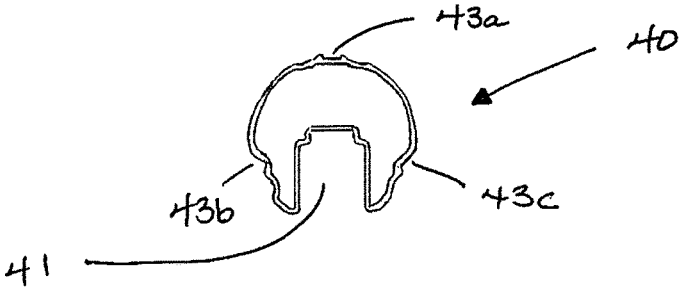
FIGS. 6A to 6D illustrate views of a guidance tube of the hanging storage system, according to an embodiment of the present invention.
Figure 6B:
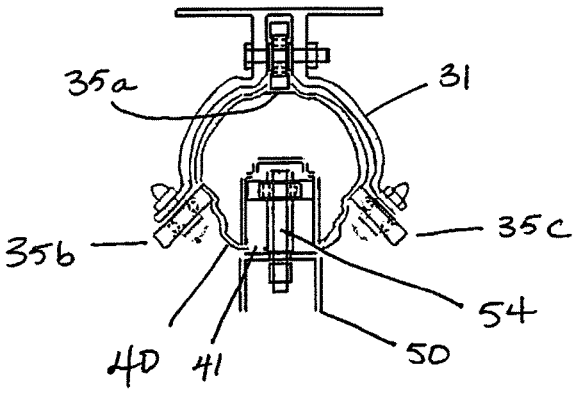
Figure 6C:
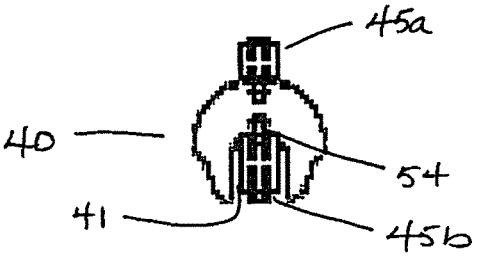
Figure 6D:
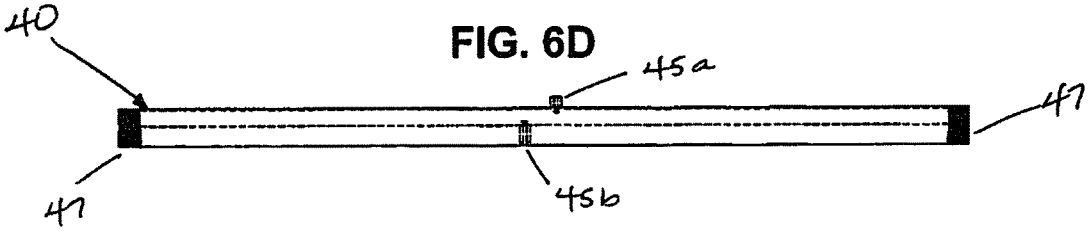

Referring to FIGS. 6A to 6C, a front view of the guidance tube 40 is provided. Referring to FIG. 6D, a cross-sectional side view of the guidance tube 40 is provided. The guidance tube 40 is tubular structure, as shown in FIG. 6D, and has a length greater than the length of the hanging storage system 100. The guidance tube 40 is shaped to fit in the guidance tube enclosure 31 of the guide assembly 38. The guidance tube 40 has an opening 41 on a bottom side for coupling the panel 50 to the guidance tube 40 (as shown in FIG. 6B). The guidance tube 40 has a first groove 43*a* on the top center, a second groove 43*b* on a lower left side, and a third groove 43*c* on a lower right side. The positions of the first groove 43*a*, the second groove 43*b*, and the third groove 43*c* correspond with the positions of the first roller 35*a*, the second roller 35*b*, and third roller 35*c* of the guidance tube enclosure 31 so that when the guidance tube 40 is inserted into the guidance tube enclosure 31, the rollers cause the guidance tube 40 to travel smoothly through the guidance tube enclosure 31. There is a stopper 45*a* (as shown in FIGS. 6C and 6D) disposed on a top surface the guidance tube 40 to prevent the guidance tube 40 from disengaging from the guidance tube enclosure 31 when it is moved. There is also a stopper 45*b* (as shown in FIGS. 6C and 6D) disposed on an inner surface, i.e. in the opening 41, to prevent the panel 50, when attached, from disengaging from the guidance tube 40. Additionally, the ends of the guidance tube 40 have caps 47 (as shown in FIG. 6D) composed of a soft material, such as rubber, to prevent the guidance tube 40 from damaging external items when the guidance tubes 40 are extended outside of the hanging storage unit 100.

Figure 7A:
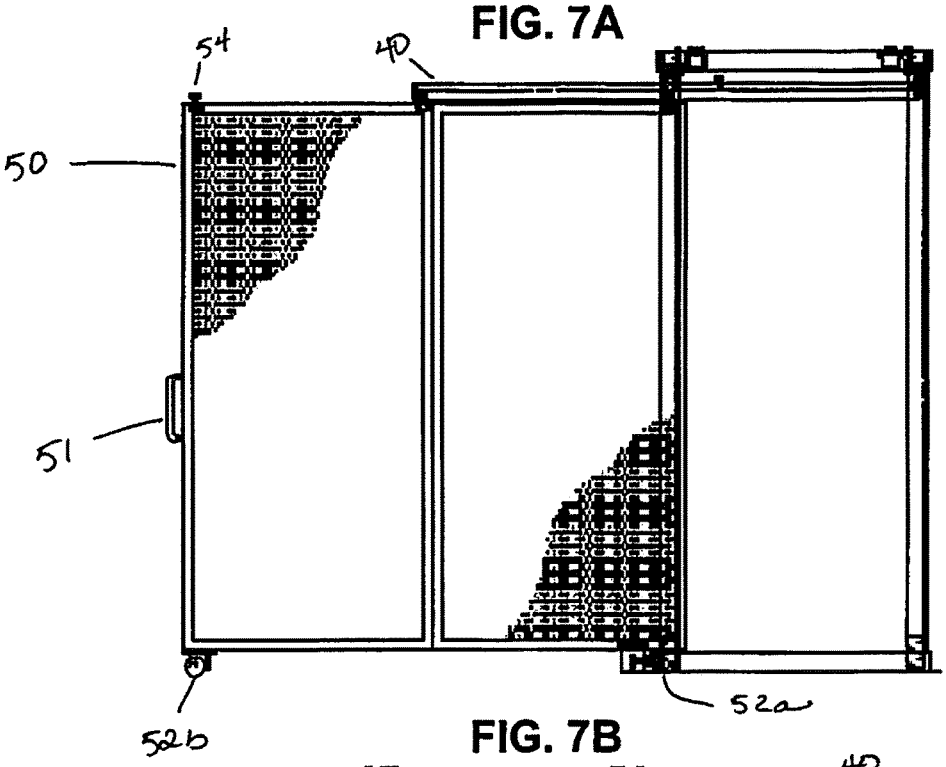
FIGS. 7A and 7B illustrate views of a panel of the hanging storage system, according to an embodiment of the present invention.
Figure 7B:
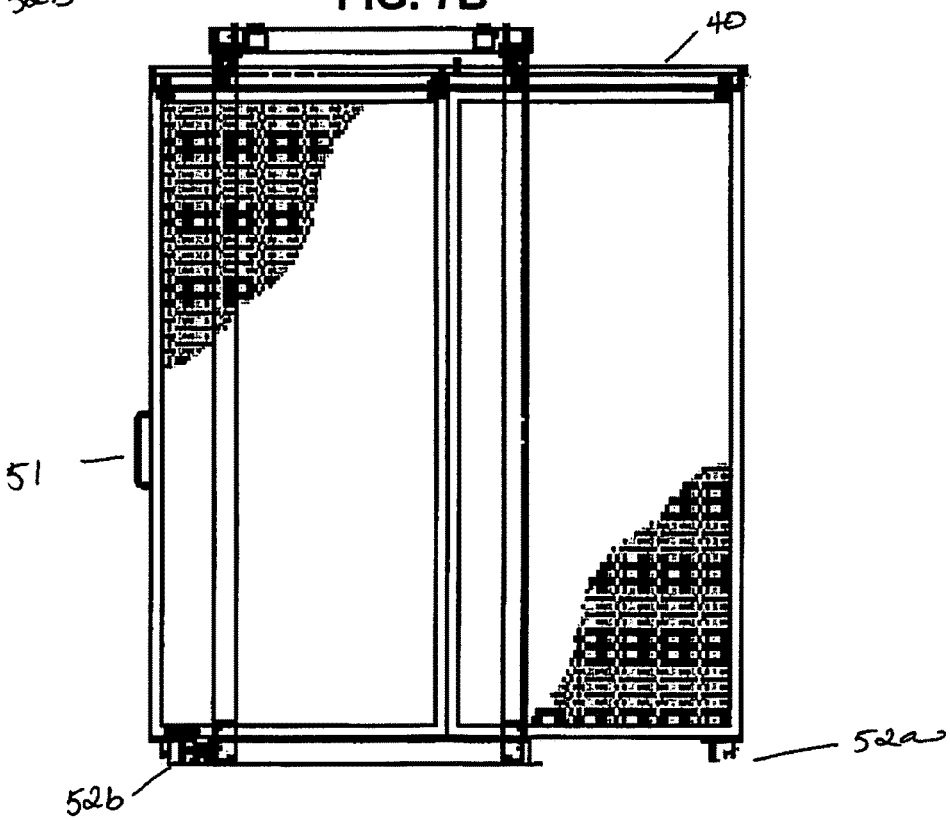

FIGS. 7A and 7B illustrate views of a panel of the hanging storage system, according to an embodiment of the present invention.

Referring to FIGS. 7A and 7B, respectively, a panel 50 in the extended and the closed position is provided. The panel 50 is composed of one or more frames including flattened and expanded diamond aluminum sheet metal. Hooks of a variety of shapes and sizes may be attached to the openings in the diamond sheet metal for hanging various items. The panel 50 has on a top surface a plurality of pins 54 (see FIG. 6B) disposed at various intervals. To couple the panel 50 to the guidance tube 40, the plurality of pins 54 is engaged in the opening 41 of the guidance tube 40 (as shown in FIGS. 6B and 6C). The stopper 45*b* stops at least one of the plurality of pins 54 so that the panel 50 does not disengage from the guidance tube 40. The lower end of the panel 50 is inserted in the space between the first roller 19*a* and the second roller 19*b* and the third roller 19*c* and the fourth roller 19*d* (see FIG. 3A). The panel includes a handle 51 to pull or push the panel 50 into the extended (opened) or retracted (closed) positions. The first wheel 52*a* and the second wheel 52*b* are used to roll the panel 50 along the surface as the panel 50 is being pushed or pulled.

The panel 50 may be provided in various sizes, such as 4'×12', 5'×10', 6'×8', etc.

Figure 8A:
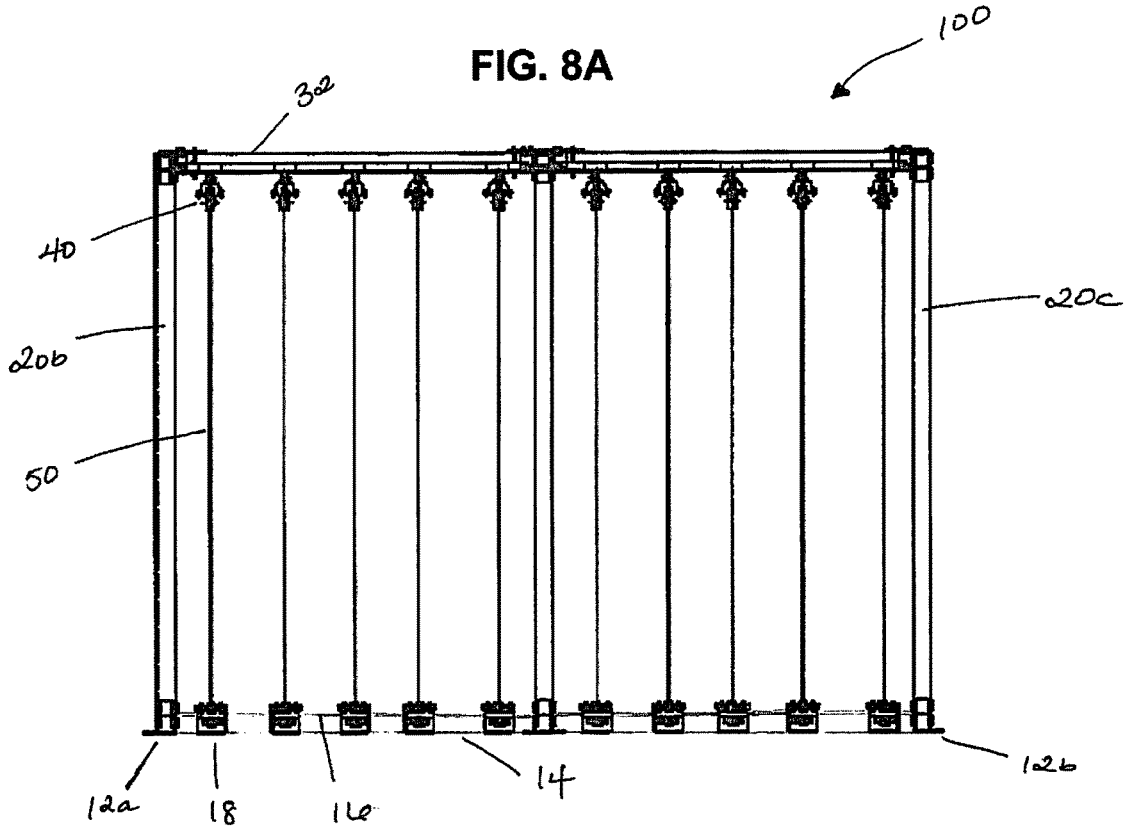
FIGS. 8A and 8B illustrate views of a hanging storage system, according to an embodiment of the present invention.
Figure 8B:
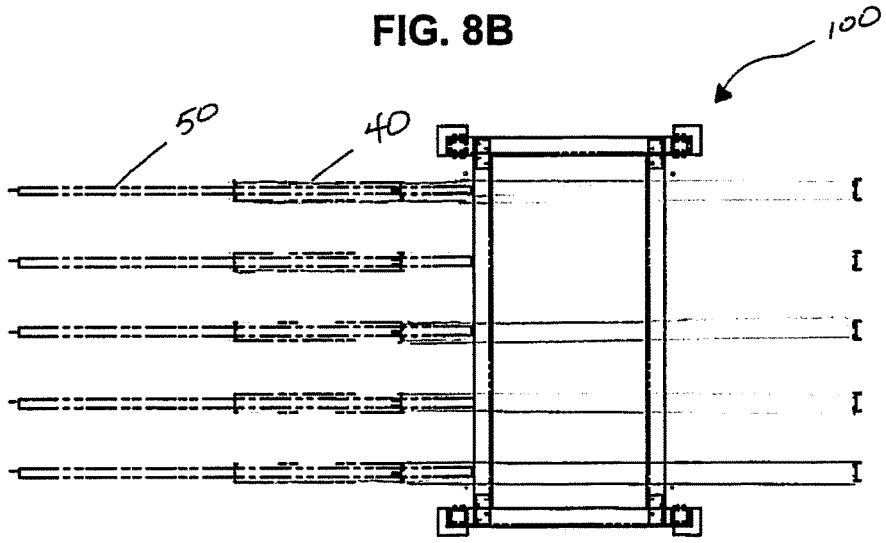

FIGS. 8A and 8B illustrate views of a hanging storage system, according to an embodiment of the present invention.

Referring to FIGS. 8A and 8B, front and top views of a hanging storage system 100 are provided, respectively. As shown in FIG. 8A, for larger systems the frame of the hanging storage system 100 may have additional structural support at a center or other position to support the load of the system. In this case, the additional structural support will be configured in the manner described with reference to FIG. 1A, to include a base extrusion 12 attached to a post 20, which is in turn attached to the upper frame structure 30. FIG. 8B shows the hanging storage system 100 from the top with the panels 50 in a fully extended position.

While the present invention has been shown and described with reference to various embodiments, it will be understood by those skilled in the art that various changes in form and details may be made therein without departing from the spirit and scope of the present invention. Therefore, the scope of the present invention is defined not by the detailed description of the present invention, but by the appended claims and their equivalents, and thus, all differences within the scope will be construed as being included in the present invention.

What is claimed:

1. A hanging storage unit comprising:

a panel;

a lower frame structure including at least one roller assembly comprising:

a bar having a plurality of wheels operably coupled thereto, a bracket attached to the bar, and a magnetic catch positioned between the plurality of wheels;

an upper frame structure including at least one guide assembly, an upper rectangular frame, and an upper guidance structure coupled to the upper rectangular frame;

a plurality of posts operably coupled to the lower frame structure and the upper frame structure; and a guidance tube movable relative to the at least one guide assembly, wherein the bracket has a bottom and two sides, wherein the plurality of wheels are coupled to the two sides of the bracket, and wherein the magnetic catch is positioned in a space between the plurality of wheels, wherein the upper guidance structure comprises:

a first upper guidance rail, wherein a first guide assembly of the at least one guide assembly is disposed thereon; and a second upper guidance rail, wherein a second guide assembly of the at least one guide assembly is disposed thereon, wherein the first upper guidance rail and the second upper guidance rail are disposed substantially parallel to each other and are separated by at least one bar, and the first upper guidance rail and the second upper guidance rail are vertically adjustable, wherein a first ruler is printed on the lower guidance rail, a second ruler is printed on the first upper guidance rail, a third ruler is printed on the second upper guidance rail, and when a point at which the at least one roller assembly is positioned on the first ruler, a point on the at which the first guide assembly is positioned on the second ruler, and a point at which the second guide assembly is positioned on the third ruler are the same:

the at least one roller assembly, the first guide assembly, and the second guide assembly are aligned, the guidance tube is engaged with the first guide assembly and the second guide assembly, and the lower end of the panel is engaged with the at least one roller assembly.

2. The hanging storage unit of claim 1, wherein an upper end of the panel is configured to attach to the guidance tube and a lower end of the panel is configured to moveably engage with the at least one roller assembly.

3. The hanging storage unit of claim 1, wherein the lower frame structure includes a U-shape having three sides, and further includes a lower end and an upper end, wherein the plurality of posts are operably coupled to the lower end and upper end; and wherein the at least one roller assembly is attached to a third side of the three sides.

4. The hanging storage unit of claim 3, wherein the three sides of the lower frame structure comprise:

a first side comprising a first base extrusion;

a second side comprising a second base extrusion; and the third side comprising a lower guidance structure coupled to a first end of the first base extrusion and a first end of the second base extrusion, and wherein the at least one roller assembly is disposed on a lower guidance rail of the lower guidance structure.

5. The hanging storage unit of claim 4, wherein each of the first and second base extrusions include a bracket projected from each end for coupling the plurality of posts, and wherein the first and second base extrusions are positioned substantially parallel to each other.

6. The hanging storage unit of claim 1, wherein at least one of a portion of a wheel of the panel and a structure of the wheel is composed of a ferromagnetic material, and when the panel is engaged in the space and the panel is in a closed position, the at least one of the portion of the wheel of the panel and the and structure of the wheel magnetically couples with to the magnetic catch.

7. The hanging storage unit of claim 1, wherein the upper rectangular frame includes a bracket projected from each corner for coupling to the plurality of posts.

8. The hanging storage unit of claim 1, wherein the at least one guide assembly comprises:

a guidance tube enclosure; and a plurality of rollers attached to the guidance tube enclosure.

9. The hanging storage unit of claim 2, wherein the guidance tube comprises:

an opening on a bottom side for attaching the panel;

at least one stopper; and a plurality of grooves on the surface for engaging with rollers of a guidance tube enclosure of the at least one guide assembly.

10. The hanging storage unit of claim 9, wherein the guidance tube has a shape corresponding to the guidance tube enclosure, and wherein the guidance tube comprises:

grooves on a surface in positions corresponding to the positions of the plurality of rollers attached to the guidance tube enclosure, an opening on a bottom side corresponding to a shape of a pin attached to the panel, and a cap on each end for protecting external surfaces from contact with the guidance tube.

11. The hanging storage unit of claim 9, wherein the guidance tube is inserted into the guidance tube enclosure, the panel is coupled to the opening of the guidance tube by a plurality of pins, and the panel is engaged in a space of the at least one roller assembly.

12. The hanging storage unit of claim 2, wherein the panel comprises:

one or more frames including a diamond sheet metal surface;

a plurality of wheels on a lower surface; and a plurality of pins on an upper surface.

13. The hanging storage unit of claim 1, wherein the at least one roller assembly is removable, and a position of the at least one roller assembly is adjustable.

14. The hanging storage unit of claim 1, wherein the at least one guide assembly is removable, and a position of the at least one guide assembly is adjustable.

15. A storage unit comprising:

a panel;

a lower frame;

an upper frame;

a lower guidance rail; and an upper rectangular frame having an upper guidance structure coupled thereto, a plurality of posts operably coupled to the lower frame and the upper frame, wherein the lower frame comprises at least one roller assembly, a bar having a plurality of wheels operably coupled thereto, a bracket attached to the bar, and a magnetic catch, wherein the bracket has a bottom and two sides, wherein the plurality of wheels are coupled to the two sides of the bracket, and wherein the magnetic catch is positioned between the plurality of wheels wherein the upper guidance structure comprises a first upper guidance rail and a second upper guidance rail, wherein the first upper guidance rail and the second upper guidance rail are substantially parallel to each other, and wherein a first ruler is printed on the lower guidance rail, a second ruler is printed on the first upper guidance rail, and a third ruler is printed on the second upper guidance rail.

16. The storage unit of claim 15, wherein at least a portion of a wheel of the panel is configured to magnetically couple with to the magnetic catch.

* * * * *